US005618166A

United States Patent [19]

Legett et al.

[11] Patent Number: 5,618,166

[45] Date of Patent: Apr. 8, 1997

[54] SUBMERSIBLE PUMP FOR PUMPING RADIOACTIVE LIQUIDS

[75] Inventors: Clive Legett; Leonard S. D. Taylor; Colin Walton; Simon J. White, all of Cumbria, United Kingdom

[73] Assignee: British Nuclear Fuels plc, Warrington, United Kingdom

[21] Appl. No.: 313,242

[22] PCT Filed: Feb. 4, 1994

[86] PCT No.: PCT/GB94/00208

§ 371 Date: Nov. 16, 1994

§ 102(e) Date: Nov. 16, 1994

[87] PCT Pub. No.: WO94/18457

PCT Pub. Date: Aug. 18, 1994

[30] Foreign Application Priority Data

Feb. 4, 1993 [GB] United Kingdom ..... 9302173

[51] Int. Cl.[6] ..... F04B 17/00

[52] U.S. Cl. ..... 417/313; 417/405

[58] Field of Search ..... 417/313, 375, 417/405, 406, 423.3, 423.9, 360, 234

[56] References Cited

U.S. PATENT DOCUMENTS 3,759,290 9/1973 D'Alba ..... 417/406

4,138,202 2/1979 Eller ..... 417/390

*Primary Examiner*—Timothy Thorpe

*Assistant Examiner*—Peter G. Korytnyk

*Attorney, Agent, or Firm*—Nixon & Vanderhye P.C.

[57] ABSTRACT

A submersible pump for pumping radioactive liquids comprises a pump cartridge (2) which is removably mounted in a cavity (3) formed in the pump body (1). Seals (**30*a*, 30*b*) are provided between the cartridge (2) and the cavity (3). The cartridge houses a pneumatically operated motor to drive an impeller which discharges liquid through an outlet duct (10). Compressed air required for driving the motor is supplied through an air inlet tube (12) and air exhausted from the motor is conveyed through an air outlet tube (14). Both the air inlet and the air outlet tubes extend through the interior of the outlet duct (10**).

8 Claims, 3 Drawing Sheets

1
2
3
4
5
6
7
8
9
10
10a
11
12
13
14
16
18
22
26
29
30a
30b
34

SUBMERSIBLE PUMP FOR PUMPING RADIOACTIVE LIQUIDS

This invention relates to a submersible pump for pumping liquids, particularly radioactive liquids, from a tank or similar vessel.

FIELD OF THE INVENTION

In the nuclear industry, particularly in nuclear fuel reprocessing operations, there are a number of processes in which radioactive liquids require to be transferred by means of a pump. One such process is the decanning of spent nuclear fuel elements. This process involves transporting the spent fuel elements in water-filled skips from a storage pond into a shielded decanning cave where the cladding is mechanically stripped from the fuel elements. Water, which is radioactively contaminated by the spent fuel elements, is then removed from the skips by pumps.

Operations within the decanning cave are controlled from outside the cave so as to protect the operators from exposure to radiation. It is important therefore that the pumps can be serviced or maintained in the cave by the use of remotely controlled manipulators installed in the cave. When a pump becomes inoperative or malfunctions it is desirable that repairs are carried out quickly and, in particular, that replacement of defective components can be achieved by use of a manipulator.

Another desirable feature is that the pump should be as compact as possible so that when it is scrapped the volume of radioactive waste for disposal is kept to a minimum.

SUMMARY OF THE INVENTION

According to the invention there is provided a submersible apparatus for pumping radioactive liquids in which the apparatus is submersed, said apparatus comprising a pump cartridge, said pump cartridge having a casing provided with a liquid inlet and a liquid outlet and adapted for housing an impeller and a pneumatically operated motor to which the impeller is drivingly connected, the apparatus further comprising a pump body having a cavity formed therein in which said pump cartridge is removably mounted, and a liquid outlet duct communicating with the liquid outlet in the cartridge casing and extending from the pump body for conveying pumped liquid to a remote location, wherein compressed air is supplied to the motor through an air inlet tube extending through the liquid outlet duct and air is exhausted through an air outlet tube extending through the interior of the liquid outlet duct.

Preferably the liquid outlet duct includes a flexible hose through which the air inlet tube and air outlet tube pass to said remote location. The liquid outlet duct may further include a pipe formed on and extending from the pump body, the flexible hose being connected to the pipe to form a continuous liquid outlet duct.

In a preferred embodiment the cartridge casing includes an interior pump chamber housing the impeller, the liquid inlet being arranged coaxially with the pump chamber, and a filter located at said liquid inlet for removing solid matter entrained in the liquid passing into the pump chamber, the cartridge casing further including an interior motor chamber arranged coaxially with the pump chamber and housing the motor, the motor chamber having a further filter for removing solid matter from the compressed air passing to the motor.

The compressed air preferably is supplied to the motor through an air inlet passage formed in and extending through the pump body and communicating with the air inlet tube and the pump body cavity, and air is exhausted from the motor through an air outlet passage formed in and extending through the pump body and communicating with the air outlet tube and the pump body cavity.

Preferably, seals are interposed between the cartridge casing and the pump body cavity, a first seal being arranged between the positions at which the air inlet passage and the air outlet passage communicate with the pump body cavity, and a second seal being arranged between the positions at which the air outlet passage and the liquid outlet communicate with the pump body cavity.

Advantageously, an external screw thread is provided on the cartridge casing and a corresponding internal screw thread is formed on the pump body cavity for receiving the external screw thread on the cartridge casing when the pump cartridge is mounted in the pump body cavity, and wherein handle means are provided on the cartridge casing, the arrangement being such that movement of the handle means causes rotation of the pump cartridge with respect to the pump body, whereby the pump cartridge can be removed from the pump body cartridge.

The handle means may comprise a plate extending across the liquid inlet.

BRIEF DESCRIPTION OF THE DRAWINGS

Embodiments of the invention will now be described, by way of example only, with reference to the accompanying drawings, in which.

BRIEF DESCRIPTION OF THE PREFERRED EMBODIMENTS

Figure 1:
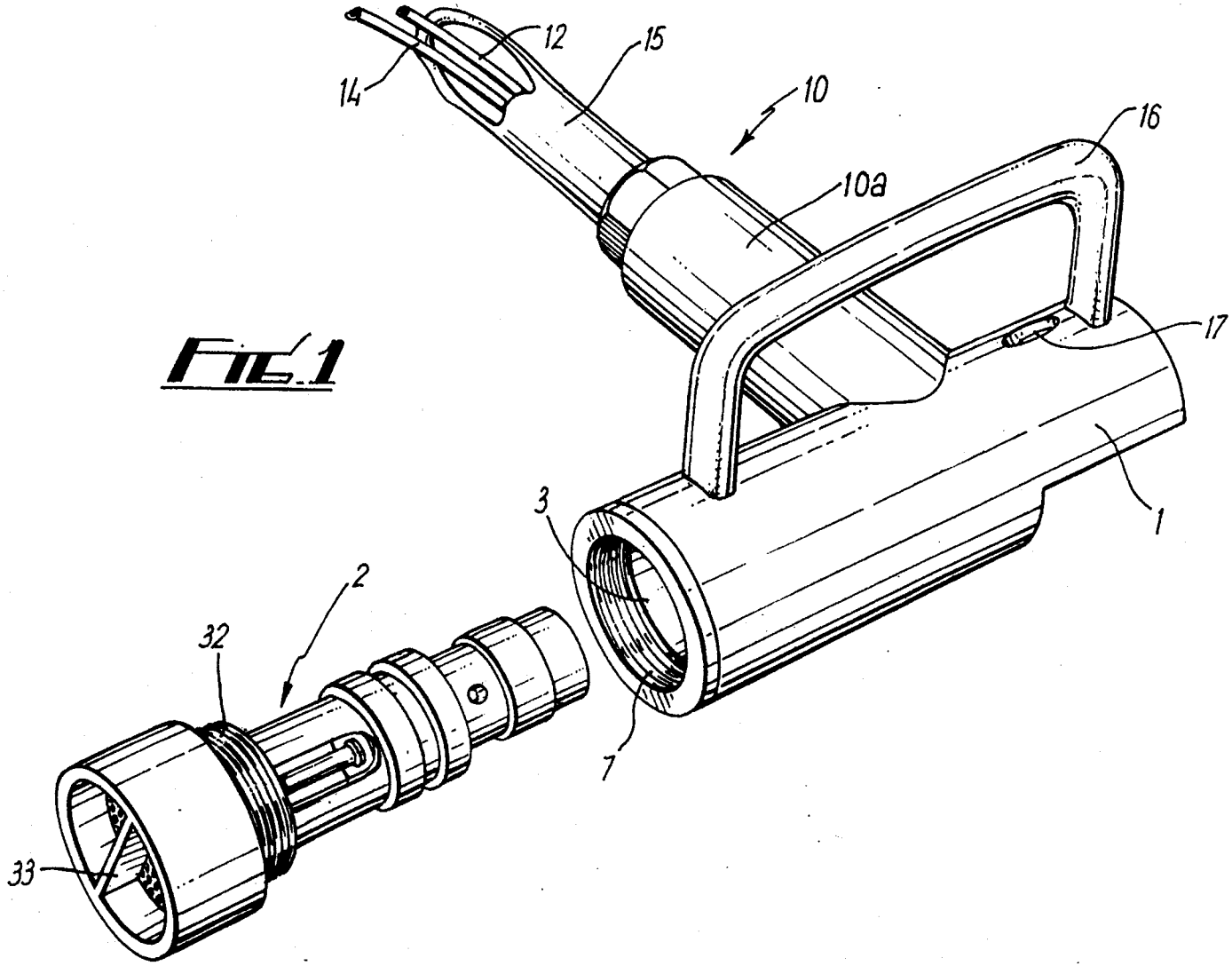
FIG. 1 is an exploded isometric diagram of a submersible pump assembly.

As seen in FIG. 1, a submersible pump assembly, suitable for operation within a radioactively contaminated liquid, comprises a pump body 1 and a pump cartridge 2. The pump cartridge 2 is shown withdrawn from the pump body, but, in use, it is located within a cavity 3 formed in the pump body, as illustrated in FIG. 2.

Figure 2:
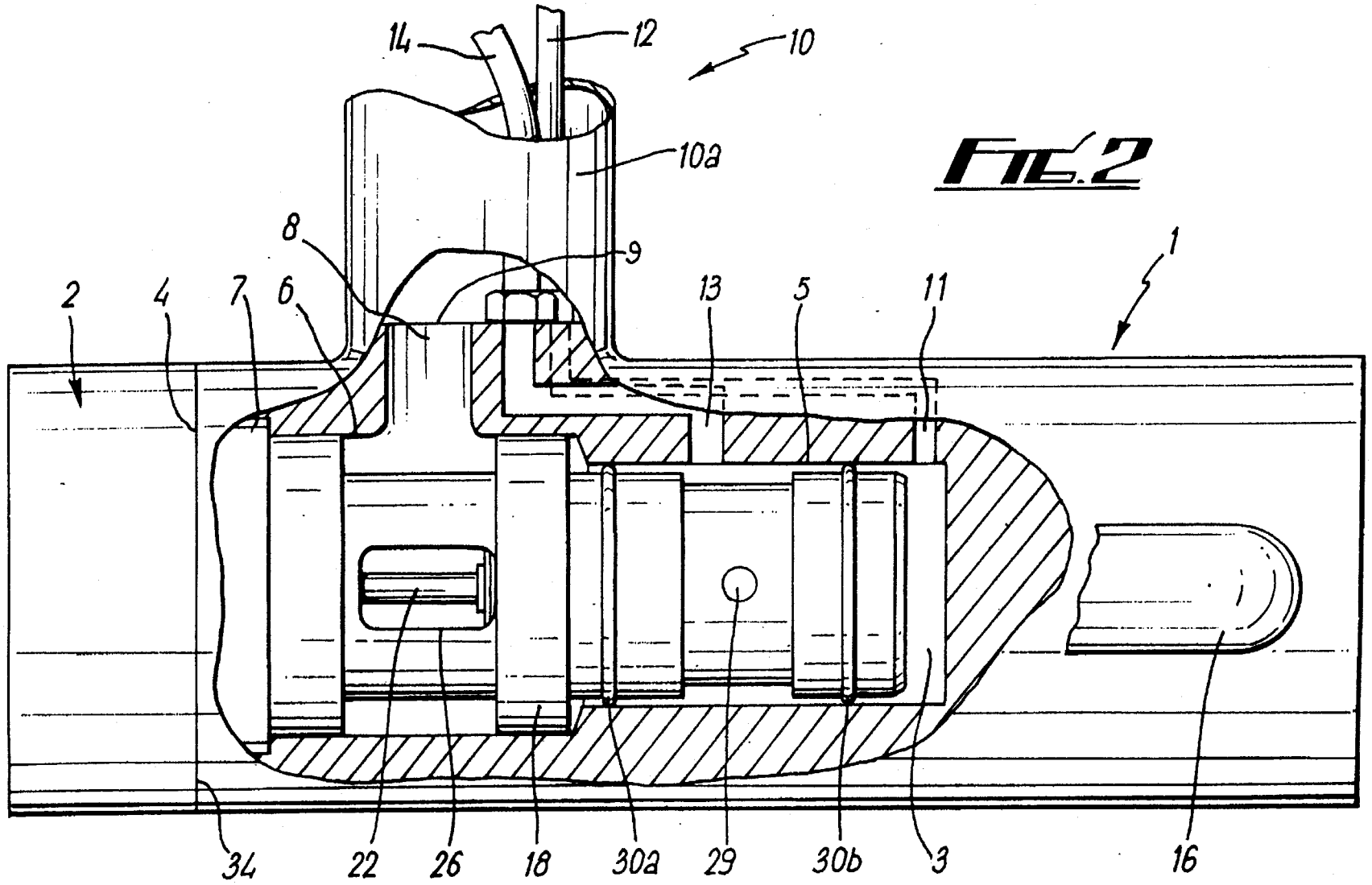
FIG. 2 is a part sectional plan view of the submersible pump assembly.

Referring to FIG. 2, the cavity 3 extends from a front surface 4 of the body 1 and has a rear section 5 and a front section 6. An internal screw thread 7 is machined at the entrance to the cavity front section 6. A liquid outlet passage 8 extends laterally from the cavity front section 6 and communicates at a face 9 with an outlet duct 10 which includes a short outlet pipe **10*a* branching from the pump body 1. An air inlet passage 11, extending through the pump body 1, communicates with the cavity rear section 5. At the face 9 the air inlet passage 11 is connected to an air inlet tube 12 which passes through the outlet pipe 10*a*. An air outlet passage 13, extending through the pump body 1, also communicates with the cavity rear section 5. At the face 9 the air outlet passage 13 is connected to an air outlet tube 14 which passes through the outlet pipe 10*a*. As seen in FIG. 1, the outlet duct 10 includes a flexible discharge hose 15, connected to the outlet pipe 10***a*, through which the pump discharges the liquid to a remote location, not shown. Each of the air inlet and outlet tubes 12, 14 passes through the interior of the hose 15 to a remote air supply and discharge location. Enclosing the air inlet and air outlet tubes 12, 14 within the discharge hose 15 has the advantage that the two tubes are prevented from straying and becoming entangled with other equipment, such as the remotely controlled manipulator used to handle and position the pump in the liquid.

To facilitate handling of the pump by a remotely controlled manipulator, a handle 16 is provided on the pump body 1. When not in use, the pump can be suspended on a suitable projection by a hole 17 formed in the pump body 1.

Figure 3:
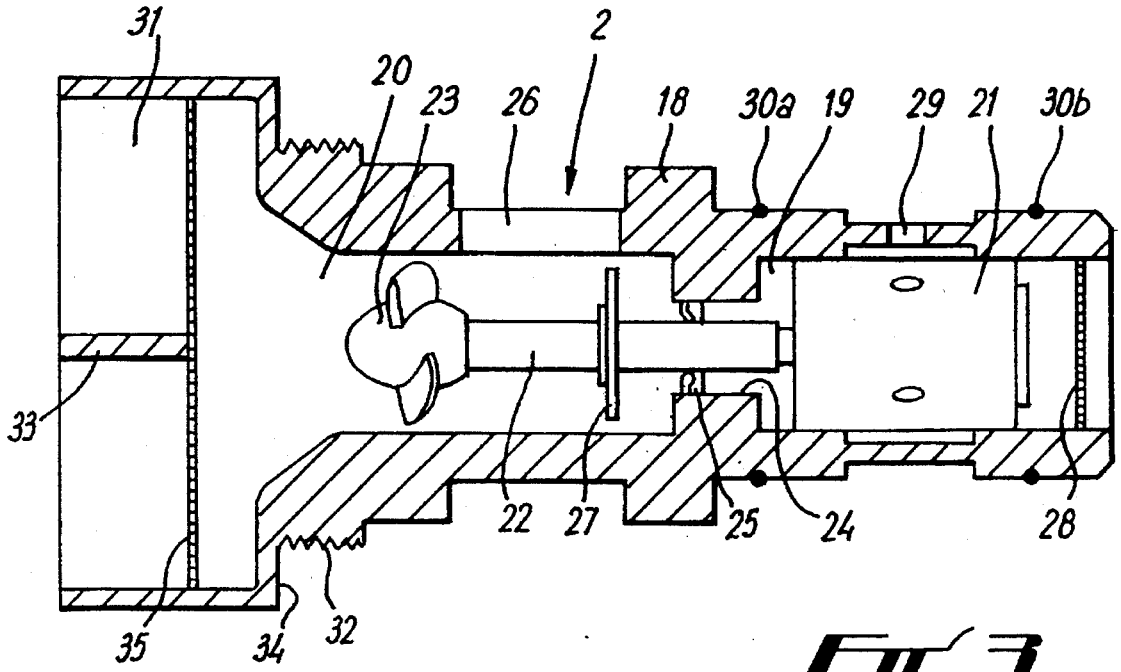
FIG. 3 is a sectional side elevation of a pump cartridge according to a preferred embodiment of the invention.

A preferred embodiment of the pump cartridge 2, incorporating an axial flow pumping arrangement, is shown in FIG. 3. The pump cartridge 2 comprises a casing 18 which is formed with an internal motor chamber 19 and an internal pump chamber 20. Located in the motor chamber 19 is a pneumatically operated motor 21 from which a drive shaft 22 extends into the pump chamber 20. Mounted on the end of the drive shaft 22 and located within the pump chamber 20 is an axial impeller 23. The drive shaft 22 extends through a passage 24 formed by a reduced internal diameter portion of the casing between the motor and pump chambers 19, 20. In the passage 24 is a shaft seal 25 which seals against the drive shaft 22 and serves to prevent the ingress of liquid into the motor chamber 19. The impeller 23 is positioned forwardly of a liquid outlet 26 for liquid discharged from the pump chamber 20. A guard plate 27, fixed to the drive shaft 22 in the region of the rearmost limit of the liquid outlet 26, serves to inhibit the flow of liquid towards the passage 24.

Compressed air for operating the motor 21 is cleaned by an air filter 28 positioned at the entrance to the motor chamber 19. Compressed air exhausted from the motor 21 exits through a hole 29 formed in the casing surrounding the motor chamber 19. Encircling the external surface of the casing surrounding the motor chamber 19 are two O-rings 30*a*, 30*b*, which, when the pump is assembled as shown in FIG. 2, seal against the cavity rear section 5 of the pump body 1. The rearmost seal 30*b* locates against the surface of the cavity rear section 5 and is arranged between the positions at which the air inlet passage 11 and the air outlet passage 13 communicate with the pump body cavity 3. The other seal 30*a* is arranged between the positions at which the air outlet passage 13 and the liquid outlet passage 8 communicate with the pump body cavity 3 so as to provide a seal between the front cavity section 6 and the rear cavity section 5.

At the forward end of the pump cartridge 2 the pump chamber 20 opens out into a liquid inlet chamber 31. The diameter of the casing surrounding the inlet chamber 31 corresponds to the external diameter of the pump body 1. Behind the inlet chamber 31 is an external screw thread 32 machined on the casing, the dimensions of the screw thread corresponding to those of the internal screw thread 7 formed in the cavity front section 6 of the pump body 1.

Extending diametrically across the inlet chamber 31 is a plate 33 which serves as a handle for use by a remotely controlled manipulator when removing or installing a pump cartridge 2 in the pump body 1. When the pump cartridge 2 is installed in the pump body (FIG. 2) a rear external surface 34 of inlet chamber 31 abuts against the front surface 4 of the pump body. Behind the plate 33 is a filter 35, which, in use, serves to remove solid matter from liquid passing through the inlet chamber 31 to the impeller 23.

Figure 4:
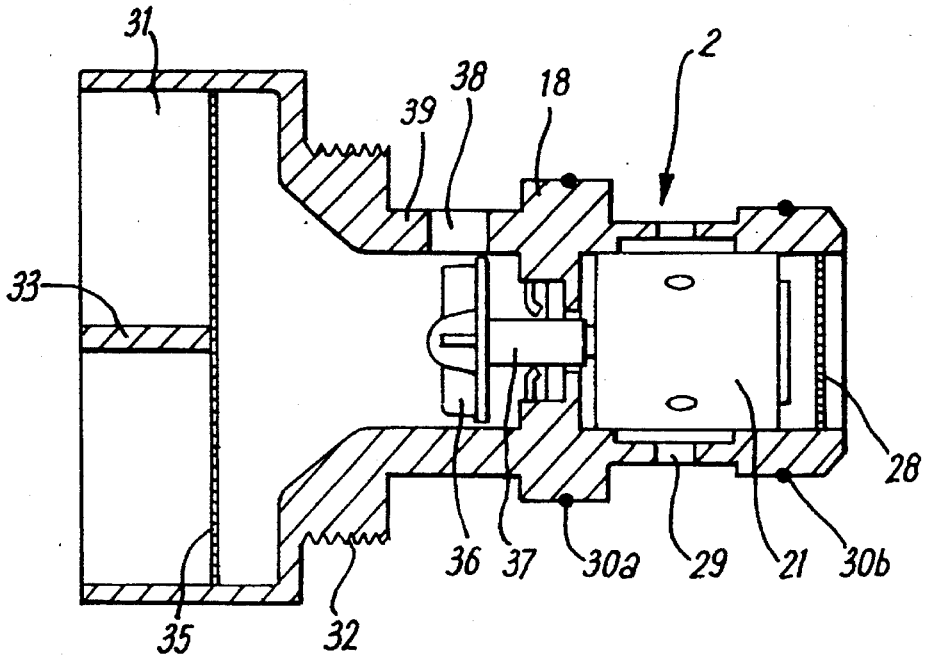
FIG. 4 is a sectional side elevation of a pump cartridge according to a further embodiment of the invention.

FIG. 4 illustrates an alternative design for the pump cartridge 2 which incorporates a centrifugal type pump.

In this embodiment, a centrifugal impeller 36 is mounted on the of a drive shaft 37 extending from the pneumatically operated motor 21. The impeller 36 is positioned in line with a liquid outlet 38 provided in the pump casing 39. In all other respects the pump cartridge is similar to the embodiment illustrated in FIG. 3, but has the advantage that it is shorter in length and is therefore even more compact.

In use, referring particularly to FIGS. 2 and 3, a pump assembly comprising a pump cartridge 2 and a pump body 1 is immersed in the liquid to be pumped away using a remotely controlled manipulator. In a particularly suitable application, the pump assembly is immersed in radioactively contaminated water which requires pumping from a skip used to transport spent nuclear fuel elements into a decanning cave. The manipulator grips the handle 16 and positions the pump assembly at the desired location within the skip. At a remote location pressurised air is admitted to the air inlet tube 12 through which the air is conveyed to the air inlet passage 11 in the pump body 1. The pressurised air enters the cavity rear section 5, passes through the filter 28 to remove any solid particles entrained in the airstream, and then enters the motor 21 so as to impart rotation to the shaft 22 and the axial impeller 23.

Air exhausted from the motor 21 is discharged through the hole 29 in the casing 18 and then through the air outlet passage 13 in the pump body 1. The exhausted air is then conveyed through the air outlet tube 14 for discharge at a remote location.

Rotation of the axial impeller 23 draws liquid into the inlet chamber 31 and through the filter 35 which extracts any solid matter entrained in the liquid. The liquid flows to the downstream side of the impeller 23 and is discharged from the pump cartridge 2 through the outlet 26 formed in the casing 18. The discharged liquid passes through the outlet passage 8 into the outlet duct 10, via the outlet pipe 10*a*, and is then conveyed for discharge at a remote location through the hose 15.

The embodiment shown in FIG. 4 operates in a similar manner, except that the liquid drawn into the pump cartridge 2 is centrifuged directly through the outlet 38 by the rotational action of the centrifugal impeller 36. The liquid discharged through the outlet 38 passes through the outlet passage 8 into the outlet duct 10, via the outlet pipe 10*a*, and is then conveyed for discharge at a remote location through the hose 15.

If the pump assembly malfunctions it is a relatively simple task to replace a defective pump cartridge with a fresh one. In such an event, a remotely controlled manipulator installed in the decanning cave is manoeuvred so that it can grip the plate 33 extending across the cartridge inlet chamber 31. The manipulator is then operated so that it rotates the pump cartridge 2. This causes disengagement of the cartridge screw thread 32 from the screw thread 7 formed on the pump body 1, so enabling the cartridge 2, together with the seals 30*a*, 30*b*, to be axially withdrawn from the body 1. The manipulator transfers the defective cartridge to a remote location where it is replaced by a new one. By a reversal of the procedure described above the new pump cartridge is inserted into the body 1.

Since all the working parts and seals form part of the pump cartridge a defective pump assembly can be repaired by simply replacing the cartridge rather than the entire assembly, so reducing repair costs. Because the pump assembly is submersed in the liquid to be pumped it has the advantage of being self-priming.

We claim:

1. A submersible apparatus for pumping radioactive liquids in which the apparatus is submersed, said apparatus comprising a pump cartridge, said pump cartridge having a casing provided with a liquid inlet and a liquid outlet and adapted for housing an impeller and a pneumatically operated motor to which the impeller is drivingly connected, the apparatus further comprising a pump body having a cavity formed therein in which said pump cartridge is removably mounted, and a liquid outlet duct communicating with the liquid outlet in the cartridge casing and extending from the pump body for conveying pumped liquid to a remote location, wherein compressed air is supplied to the motor through an air inlet tube extending through the interior of the liquid outlet duct and air is exhausted from the motor through an air outlet tube extending through the interior of the liquid outlet duct.

2. A submersible apparatus for pumping radioactive liquids according to claim 1, wherein the liquid outlet duct includes a flexible hose through which the air inlet tube and air outlet tube pass to said remote location.

3. A submersible apparatus for pumping radioactive liquids according to claim 2, wherein the liquid outlet duct further includes a pipe formed on and extending from the pump body, the flexible hose being connected to the pipe to form a continuous liquid outlet duct.

4. A submersible apparatus for pumping radioactive liquids according to claim 1 wherein the cartridge casing includes an interior pump chamber housing the impeller, the liquid inlet being arranged coaxially with the pump chamber, and a filter located at said liquid inlet opening for removing solid matter entrained in the liquid passing into the pump chamber, the cartridge casing further including an interior motor chamber arranged coaxially with the pump chamber and housing the motor, the motor chamber having a further filter for removing solid matter from the compressed air passing to the motor.

5. A submersible apparatus for pumping radioactive liquids according to claim 4, wherein the compressed air is supplied to the motor through an air inlet passage formed in and extending through the pump body and communicating with the air inlet tube and the pump body cavity, and air is exhausted from the motor through an air outlet passage formed in and extending through the pump body and communicating with the air outlet tube and the pump body cavity.

6. A submersible apparatus for pumping radioactive liquids according to claim 5, wherein seals are interposed between the cartridge casing and the pump body cavity, a first seal being arranged between the positions at which the air inlet passage and the air outlet passage communicate with the pump body cavity, and a second seal being arranged between the positions at which the air outlet passage and the liquid outlet communicate with the pump body cavity.

7. A submersible apparatus for pumping radioactive liquids according to claim 4 wherein an external screw thread is provided on the cartridge casing and a corresponding internal screw thread is formed on the pump body cavity for receiving the external screw thread on the cartridge casing when the pump cartridge is mounted in the pump body cavity, and wherein handle means are provided on the cartridge casing, the arrangement being such that movement of the handle means causes rotation of the pump cartridge with respect to the pump body, whereby the pump cartridge can be removed from the pump body cavity.

8. A submersible apparatus for pumping radioactive liquids according to claim 7, wherein the handle means comprises a plate extending across the liquid inlet.

* * * * *